US008041068B2

(12) United States Patent
Funahashi

(10) Patent No.: US 8,041,068 B2
(45) Date of Patent: Oct. 18, 2011

(54) LOUDSPEAKER

(75) Inventor: Osamu Funahashi, Osaka (JP)

(73) Assignee: Panasonic Corporation, Osaka (JP)

( * ) Notice: Subject to any disclaimer, the term of this patent is extended or adjusted under 35 U.S.C. 154(b) by 964 days.

(21) Appl. No.: 11/916,480

(22) PCT Filed: May 7, 2007

(86) PCT No.: PCT/JP2007/059450

§ 371 (c)(1),
(2), (4) Date: Dec. 4, 2007

(87) PCT Pub. No.: WO2007/129685

PCT Pub. Date: Nov. 15, 2007

(65) Prior Publication Data

US 2009/0116680 A1 May 7, 2009

(30) Foreign Application Priority Data

May 10, 2006 (JP) ..... 2006-131332
May 10, 2006 (JP) ..... 2006-131333

(51) Int. Cl.
*H04R 25/00* (2006.01)

(52) U.S. Cl. ..... 381/398; 381/403; 381/404

(58) Field of Classification Search ..... 381/396, 381/398, 403, 404, 405, 423, 432, 433, 424, 381/426; 181/171, 172, 165, 167
See application file for complete search history.

(56) References Cited

U.S. PATENT DOCUMENTS 5,847,333 A 12/1998 D'Hoogh
6,655,495 B2 12/2003 Kuze et al.
2003/0185415 A1* 10/2003 Funahashi et al. ..... 381/398
2005/0201588 A1* 9/2005 Funahashi et al. ..... 381/423

FOREIGN PATENT DOCUMENTS

| | | |
|---|---|---|
| JP | 45-33465 | 10/1970 |
| JP | 45-033465 B | 10/1970 |
| JP | 56-049188 Y | 11/1981 |
| JP | 57-037582 Y | 8/1982 |
| JP | 58-066797 U | 5/1983 |
| JP | 62-109596 | 7/1987 |
| JP | 2-133097 | 11/1990 |
| JP | 2-133097 U | 11/1990 |
| JP | 02-133097 U | 11/1990 |
| JP | 03-247099 A | 11/1991 |

(Continued)

OTHER PUBLICATIONS

Supplementary European Search Report dated Jun. 23, 2010.

(Continued)

*Primary Examiner* — Huyen D. Le
(74) *Attorney, Agent, or Firm* — Pearne & Gordon LLP

(57) ABSTRACT

Loudspeaker has frame, magnetic circuit, voice coil, diaphragm, first combination and second combination. First combination and second combination are both provided closer to magnetic circuit than diaphragm, the inner rims of which are connected to voice coil while the outer rims are to frame. First combination has first damper and first edge wherein first edge has first edge protrusion protruding in a direction toward diaphragm. Second combination has second damper and second edge wherein second edge has second edge protrusion protruding in an opposite direction to the protruding direction of first edge protrusion This structure obtains loudspeaker that distortion is suppressed and weight reduction is easy for an excursion part thus improved in driving efficiency.

6 Claims, 12 Drawing Sheets

FOREIGN PATENT DOCUMENTS

| | | | |
|---|---|---|---|
| JP | 09-284890 | A | 10/1997 |
| JP | 11-510033 | A | 8/1999 |
| JP | 2003-199192 | | 7/2003 |
| JP | 2003-199192 | A | 7/2003 |
| JP | 2004-007332 | | 1/2004 |
| WO | 99/04597 | A | 1/1999 |

OTHER PUBLICATIONS

Japanese Office action dated Jul. 13, 2010 for Appl. No. 2006-131332.

International Search Report Dated Jun. 5, 2007.

* cited by examiner

LOUDSPEAKER

THIS APPLICATION IS A U.S. NATIONAL PHASE APPLICATION OF PCT INTERNATIONAL APPLICATION PCT/JP2007/059450.

TECHNICAL FIELD

The present invention relates to a loudspeaker for use on various electronic appliances.

BACKGROUND ART

The conventional loudspeaker 100 has a magnetic circuit 101, a voice coil 102, a diaphragm 103 and a frame 105, as shown in FIG. 12. The voice coil 102 is arranged movable relative to the magnetic gap provided over the magnetic circuit 101 and connected to an inner rim of the diaphragm 103. The diaphragm 103 has an outer rim connected to the frame 105 via a diaphragm edge 104. Furthermore, diaphragm 103 has a rear surface connected to the frame 105 via a suspension holder 106 and an edge 107. By providing the protrusion form of diaphragm edge 104 and the protrusion form of edge 107 in opposite direction, the vertical excursion of diaphragm 103 is given symmetric with respect to the vertical. This reduces distortion of loudspeaker 100.

Such a conventional loudspeaker 100 is disclosed in Japanese Patent Unexamined Publication No. 2004-7332 (patent document 1), for example.

Patent Document 1: Japanese Patent Unexamined Publication No. 2004-7332

SUMMARY OF THE INVENTION

The present invention provides a loudspeaker which has a low distortion characteristic and a high driving efficiency.

A loudspeaker in the invention has a frame, a magnetic circuit, a voice coil, a diaphragm, a first combination and a second combination. The magnetic circuit, supported by the frame, is to form a magnetic gap. The voice coil is arranged movable relative to the magnetic gap. The diaphragm has an outer rim connected to the frame via a diaphragm edge and an inner rim connected to the voice coil. The first and second combinations are both provided closer to the magnetic circuit than the diaphragm, thus having an inner rim connected to the voice coil and an outer rim connected to the frame. Furthermore, the first combination has a first damper and a first edge while the second combination has a second damper and a second edge. The first edge has a first edge protrusion protruding in a direction toward the diaphragm or in a direction opposite to the diaphragm. The second edge has a second edge protrusion protruding in a direction opposite to the protruding direction of the first edge protrusion. By this structure, a loudspeaker is obtained which is to suppress the distortion in the sound the loudspeaker generates, easy to reduce the weight of the excursion part thereof, and improved in driving efficiency.

REFERENCE MARKS IN THE DRAWINGS

1. Magnetic circuit
2. Voice coil
3. Diaphragm
4. Diaphragm edge
5. Frame
8. Magnetic gap
10*a*. First damper
10*b*. Second damper
10*c*. Third damper
10*d*. Fourth damper
11*a*, 11*c*. First edge
11*b*, 11*d*. Second edge
12*a*, 12*c*. First combination
12*b*, 12*d*. Second combination
20. Loudspeaker
21*a*, 21*c*. First edge protrusion
21*b*, 21*d*. Second edge protrusion
21*e*. Third edge protrusion
21*f*. Fourth edge protrusion
22*a*. Third protrusion
22*b*. Fourth protrusion
23*a*, 23*b*. Connection
31. Spacer

DETAILED DESCRIPTION OF THE PREFERRED EMBODIMENTS

With using the drawings, embodiments of the present invention will now be explained below.

Embodiment 1

Figure 1:
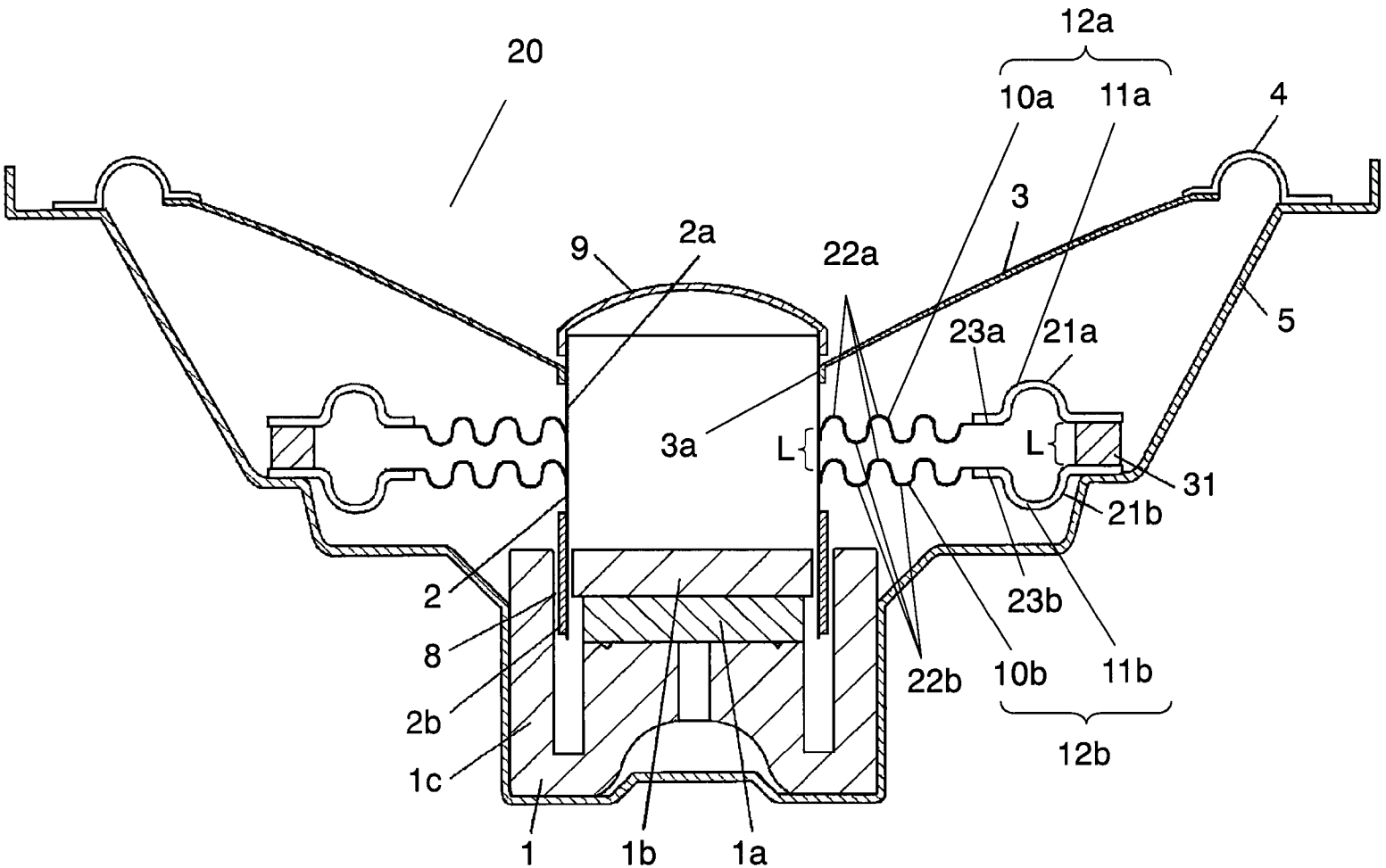
FIG. 1 is a sectional view of a loudspeaker according to embodiment 1 of the present invention.
Figure 2:
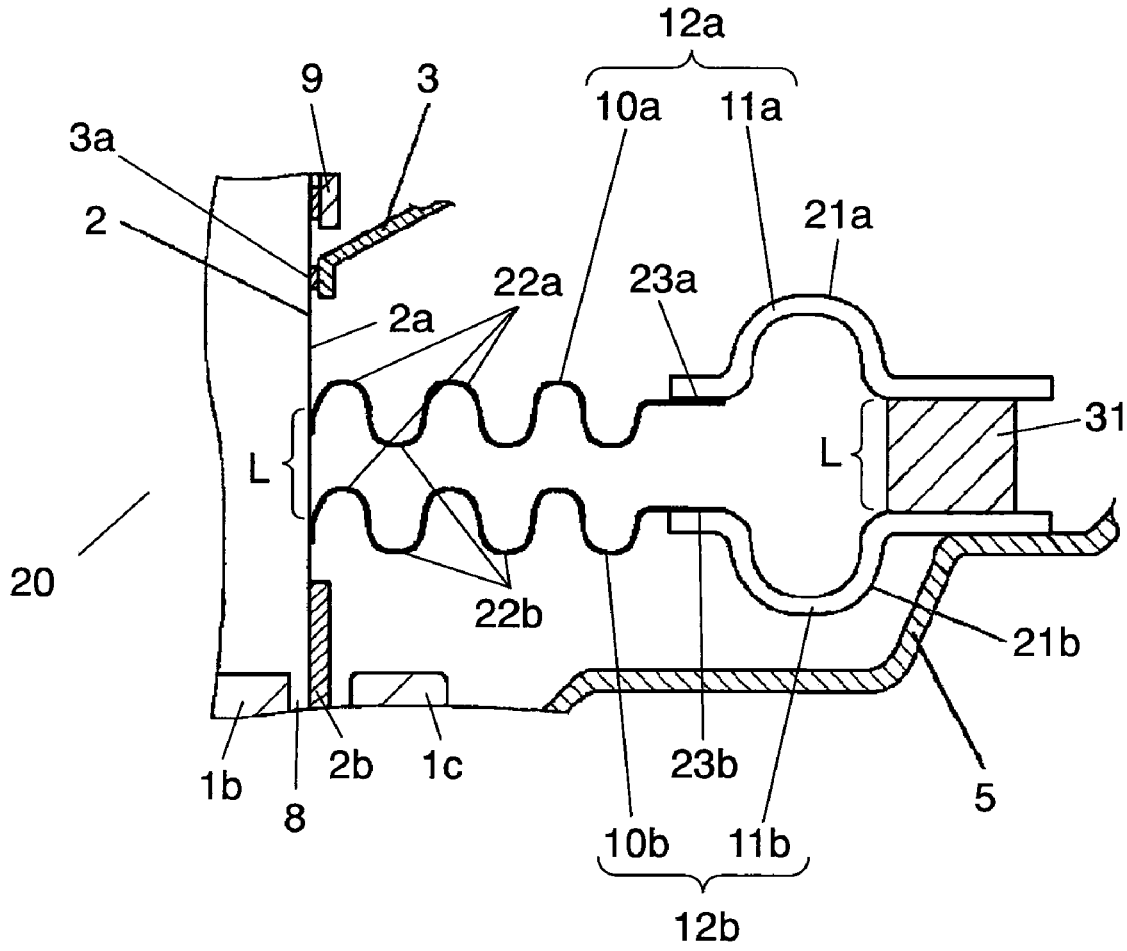
FIG. 2 is an essential-part magnifying sectional view of the loudspeaker shown in FIG. 1.

Embodiment 1 of the invention is explained below by using figures. FIG. 1 is a sectional view showing loudspeaker 20 according to embodiment 1 of the invention. FIG. 2 is an essential-part magnifying sectional view of loudspeaker 20 shown in FIG. 1. As shown in FIGS. 1 and 2, loudspeaker 20 has frame 5 in an inverted-cone form, magnetic circuit 1, voice coil 2 and diaphragm 3. Magnetic circuit 1 is arranged at a bottom center of frame 5. Furthermore, magnetic circuit 1 is formed by combining and bonding together disk-like magnet 1*a*, disk-like plate 1*b* and cylindrical yoke 1*c*. Magnetic gap 8 is formed between the inner rim surface of a sidewall of yoke 1*c* and the outer rim surface of plate 1*b*. Magnetic gap 8 has a cylindrical form opening to the above.

Voice coil 2 has cylindrical body 2*a* and coil 2*b* wound around the outer rim of body 2*a*. Voice coil 2 is connected, at its upper outer rim, with diaphragm 3 in a thin-dish form. Voice coil 2 is arranged movable vertically relative to magnetic gap 8. By the vertical operation of voice coil 2, diaphragm 3 is caused to vibrate. Incidentally, dust cap 9 is provided for dustproof, at the upper end of voice coil 2.

Diaphragm 3 is a sound generation source of loudspeaker 20. For this purpose, diaphragm 3 utilizes, as its main material, a pulp or a resin compatible with high hardness and internal loss. Diaphragm 3 has an outer rim connected to the opening end of frame 5 via diaphragm edge 4 (hereinafter, referred to as edge 4) protruding to the above. Meanwhile, diaphragm 3 has an inner rim bonded and fixed to the outer rim of body 2*a*. Edge 4 is formed by use of a material of urethane foam resin, foam rubber, SBR rubber or cloth, in order not to apply a movable load to diaphragm 3.

First damper 10*a* (hereinafter, referred to as damper 10*a*) and second damper 10*b* (hereinafter, referred to as damper 10*b*) are connected to an outer rim side of body 2*a*, as shown in FIGS. 1 and 2. Dampers 10*a*, 10*b* are connected to body 2*a*, in respective positions closer to magnetic circuit 1 than fixing region 3*a* of diaphragm 3. Damper 10*a* and damper 10*b* are connected to body 2*a*, with predetermined spacing L. Damper 10*a* has an outer rim connected to frame 5 via first edge 11*a* (hereinafter, referred to as edge 11*a*) separate from the damper 10*a*. Likewise, damper 10*b* has an outer rim connected to frame 5 via second edge 11*b* (hereinafter, referred to as edge 11*b*) separate from the damper 10*b*. Damper 10*a* and edge 11*a* constitute first combination 12*a* (hereinafter, referred to as combination 12*a*). Likewise, damper 10*b* and edge 11*b* constitute second combination 12*b* (hereinafter, referred to as combination 12*b*). Edge 11*a* and edge 11*b* are fixed on the frame 5, in a state integrated together via spacer 31. Spacer 31 has a height dimension L so that edge 11*a* and edge 11*b* can be fixed on frame 5 with predetermined distance L of spacing. The spacing between dampers 10*a* and 10*b* and the spacing between edges 11*a* and 11*b* are both structured with the predetermined distance L of spacing. However, the spacing between dampers 10*a* and 10*b* and the spacing between edges 11*a* and 11*b* are not necessarily limited to the equal spacing. Those may be determined by taking account of the forms of dampers 10*a*, 10*b*, edges 11*a*, 11*b*, spacer 31 and so on.

Dampers 10*a*, 10*b* are of a corrugated ring-like structure. This provides a structure allowing for being flexible correspondingly to a vertical excursion of voice coil 2. Dampers 10*a*, 10*b* are formed using a material of urethane foam resin, foam rubber, SBR rubber or cloth, in order not to apply a large movable load to diaphragm 3, similarly to edge 4.

Edge 11*a* has first edge protrusion 21*a* (hereinafter, referred to as protrusion 21*a*) semicircular in section that protrudes toward diaphragm 3. Likewise, edge 11*b* has second edge protrusion 21*b* (hereinafter, referred to as protrusion 21*b*) semicircular in section that protrudes oppositely to diaphragm 3. Edges 11*a*, 11*b* are formed using a material of urethane foam resin, foam rubber, SBR rubber or cloth, in order not to apply a large movable load to diaphragm 3.

Comparing between Young's modulus E0 of edge 4, Young's modulus E1 of edge 11*a* and Young's modulus E2 of edge 11*b*, it is preferred that Young's modulus E0 of edge 4 is the smallest, Young's modulus E1 of edge 11*a* is the next smallest and Young's modulus E2 of edge 11*b* is the greatest. Namely, it is preferred that the relationship E0<E1<E2 is satisfied wherein edge 4 is the softest, next, edge 11*a* is softer and edge 11*b* is the hardest. The reason of this will be detailed later. Incidentally, for example, by forming edges 4, 11*a*, 11*b* by using urethane resin, foam urethane resin or foam rubber and edge 11*b* by using rubber material, the condition E0<E1<E2 is to be obtained.

Loudspeaker 20, when inputted an audio signal to coil 2*b*, reacts with the magnetic field formed in magnetic gap 8 so that voice coil 2 operates in the vertical direction. By the operation of the voice coil 2, diaphragm 3 is vibrated to generate sound from loudspeaker 20. Particularly, by the provision of edges 11*a*, 11*b* at outer rims of dampers 10*a*, 10*b*, the sound generated by loudspeaker 20 is suppressed from distorting, further enhancing the driving efficiency of loudspeaker 20.

Usually, the inner and outer rims of dampers 10*a*, 10*b* are connected to voice coil 2 and frame 5, thus having the purpose of suppressing the rolling occurring upon operation of voice coil 2. Accordingly, dampers 10*a*, 10*b* having a corrugated ring-like structure is given with elasticity in order to easily follow up the operation of voice coil 2. By the dampers 10*a*, 10*b* having the corrugated ring-like structure, the operation of voice coil 2 less undergoes a significant load at a small excursion of voice coil 2. However, as the excursion of voice coil 2 increases, the load of dampers 10*a*, 10*b* increases on the operation of voice coil 2.

Consequently, in loudspeaker 20 according to embodiment 1, combination 12*a* has damper 10*a* and edge 11*a* while combination 12*b* has damper 10*b* and edge 11*b*. Furthermore, damper 10*a* at its outer rim is connected to frame 5 via edge 11*a*. Likewise, damper 10*b* at its outer rim is connected to frame 5 via edge 11*b*. This increases the excursion of voice coil 2, to apply a stress to edges 11*a*, 11*b* when damper 10*a*, 10*b* exerts load to voice coil 2 or so. For this reason, protrusion 21*a* of edge 11*a* elastically deforms in accordance with the stress applied to edge 11*a*. Likewise, protrusion 21*b* of edge 11*b* elastically deforms in accordance with the stress applied to edge 11*b*. Owing to the semicircular sectional form of protrusions 21*a*, 21*b*, edges 11*a*, 11*b* are smooth in its elastic deformation to smoothly absorb the stress applied to edges 11*a*, 11*b*. Incidentally, loudspeaker 20 shown in FIGS. 1 and 2 has protrusions 21*a*, 21*b* that are semicircular in sectional form. However, the sectional form of protrusion 21*a*, 21*b* is not limited to semicircular form. Namely, provided that the form allows the stress applied to edge 11*a*, 11*b* to concentrate at protrusion 21*a*, 21*b* and smoothly elastically deform edge 11*a*, 11*b*, acute-angled protrusion in section or elliptic protrusion (not shown), for example, is applicable.

Therefore, even when voice coil 2 has an increasing excursion, the excursion of voice coil 2 is less hindered by the presence of dampers 10*a*, 10*b* and edges 11*a*, 11*b*. As a result, the driving efficiency of loudspeaker 20 is suppressed from lowering.

In embodiment 1, voice coil 2 is vertically held by three supports of edge 4, combination 12*a* and combination 12*b*. In order to enhance the driving efficiency of the driver 20, edge 4 greatest in plane shape is thin-walled to reduce the weight of the excursion part including diaphragm 3, edge 4 and the like. This reduces the weight of diaphragm 3 and the weight of edge 4, to enhance the driving efficiency of loudspeaker 20. Meanwhile, where edge 4 is thin-walled, the support strength of voice coil 2 lowers. For this reason, edge 11*a* and edge 11*b* are structured thick-walled rather than edge 4. This compensates for the lowering the support strength of voice coil 2. Namely, Young's modulus Ea of combination 12*a* and Young's modulus Eb of combination 12*b* are greater than Young's modulus E0 of edge 4. Namely, the relationship E0<Ea and E0<Eb is satisfied, wherein combinations 12*a*, 12*b* are harder than edge 4.

In loudspeaker 20 thus structured, supporting voice coil 2 is dominated by the support of combinations 12*a*, 12*b*. Accordingly, diaphragm 3 is effectively suppressed from distorting in its vertical excursion by placing the vertical load on combination 12*a* and the vertical load on combination 12*b* in an equal state to a possible extent.

Now explanation is made on a structure that the vertical load on combination 12*a* and the vertical load on combination 12*b* are substantially equal in state.

Incidentally, dampers 10*a*, 10*b* are of a corrugated ring-like structure, each of which has a plurality of third protrusions 22*a* protruding toward diaphragm 3 and fourth protrusions 22*b* protruding oppositely to third protrusions 22*a*. Accordingly, dampers 10*a*, 10*b* basically have substantially equal vertical loads.

At first, explanation is made on edge 11*b* form. As shown in FIG. 2, edge 11*b* has protrusion 21*b* protruding to the below. Namely, protrusion 21*b* is in a form protruding opposite to diaphragm 3. Furthermore, protrusion 21*b* has substantially a semicircular form in section. This allows edge 11*b* to readily deform to the below in FIG. 2, i.e. in a direction opposite to diaphragm 3. Conversely, edge 11*b* is not ready to deform in a direction to the above in FIG. 2, i.e. toward diaphragm 3.

Meanwhile, edge 11*a* is provided in order to absorb the difference of vertical deformability of edge 11*b*. The provision of edge 11*a* serves to absorb the characteristic ready to deform to the below, the difference in vertical load on edge 11*b*. For this reason, edge 11*a* has a form opposed to edge 11*b*.

Namely, as shown in FIG. 2, edge 11*a* has protrusion 21*a* that protrudes in a direction to the above in FIG. 2, i.e. toward diaphragm 3. Furthermore, protrusion 21*a* has substantially a semicircular form in section. This makes it easy to deform in the direction to the above in FIG. 2, i.e. toward diaphragm 3. Conversely, deformation is not easy in a direction to the below in FIG. 2, i.e. opposite to diaphragm 3. In this manner, protrusions 21*a* of edge 11*a* and protrusion 21*b* of edge 11*b* are oppositely arranged to each other with a substantial semicircular form in section. Due to this, the vertical load on edge 11*a* and vertical load on edge 11*b* are given substantially equal in the state of magnitude.

Further making a detail of edges 11*a*, 11*b*, Young's modulus E1 of edge 11*a* is somewhat smaller than Young's modulus E2 of edge 11*b*. Namely, edge 4 is in a form protruding to the above in FIG. 1, as shown in FIG. 1. Consequently, taking account of the load difference at edge 4, edge 11*a* is less hard as compared to edge 11*b*.

As mentioned above, edge 4 is light in weight by virtue of its small thickness. This reduces the weight of diaphragm 3 and the weight of edge 4, to raise the driving efficiency of loudspeaker 20. Consequently, load is not so great in vertical excursion of diaphragm 3. However, because edge 4 protrudes to the above in FIG. 1, edge 4 is ready to deform to the above and conversely not easy to deform to the below. This difference, although somewhat in degree, turns into a difference of vertical excursion load as to diaphragm 3. Relative to the vertical excursion load of diaphragm 3, loudspeaker 20 of the invention has Young's modulus E1 at edge 11*a* somewhat smaller than Young's modulus E2 at edge 11*b*, as noted before. Namely, edge 11*a* is less hard as compared to edge 11*b*. This adjusts the difference of vertical excursion load of diaphragm 3 into a substantially equal state.

In other words, in FIGS. 1 and 2, voice coil 2 is easier to move to the above in FIG. 1 and the upper in FIG. 2 as compared to the excursion to the below because of the reason resulting from the forms of edge 4 and edge 11*a*. Furthermore, by the reason resulting from the form of edge 11*b*, downward excursion is easier as compared to upward excursion. From this fact, the easiness of excursion is taken into account on the assumption that edge 11*a* and edge 4 are in a pair for one edge 11*b*. By this fact, Young's modulus E1 of edge 11*a* is somewhat smaller than Young's modulus E2 of edge 11*b*. As a result, the vertical excursion of diaphragm 3 is given substantially symmetric with respect to the vertical, thus reducing distortions in loudspeaker 20. Furthermore, because edge 4 greatest in plane shape is weight-reduced, the excursion part of loudspeaker 20 can be easily reduced in weight. Thus, loudspeaker 20 having high driving efficiency is obtainable for loudspeaker 20 for reproducing middle and higher ranges of sound.

In the structure that dampers 10*a*, 10*b* are connected to frame 5 via edges 11*a*, 11*b*, the power linearity due to dampers 10*a*, 10*b* is ensured linear before the excursion of voice coil 2 increases to a certain extent. In the case the excursion of voice coil 2 becomes a predetermined width or greater and linearity becomes difficult to obtain, linearity is complemented for by the elasticity of edges 11*a*, 11*b*. Accordingly, the total Young's modulus of edges 11*a*, 11*b* are desirably greater than the total Young's modulus of dampers 10*a*, 10*b*. Namely, edges 11*a*, 11*b* are desirably harder than dampers 10*a*, 10*b*.

Meanwhile, damper 10*a* and edge 11*a* are desirably set with different Young's moduli from each other so that the both can function independently in accordance with the excursion of voice coil 2. By establishing the Young's modulus of between damper 10*a* and edge 11*a*, i.e. at connection 23*a* of damper 10*a* and edge 11*a*, greater than the Young's modulus of damper 10*a* and greater than the Young's modulus of edge 11*a*, independence of damper 10*a* and edge 11*a* is ensured for damper 10*a* and edge 11*a*. Namely, connection 23*a* is desirably harder than damper 10*a* and than edge 11*a*.

Likewise, damper 10*b* and edge 11*b* are desirably set with different Young's moduli from each other so that the both can function independently in accordance with the excursion of voice coil 2. By establishing the Young's modulus of between damper 10*b* and edge 11*b*, i.e. at connection 23*b* of damper 10*b* and edge 11*b*, greater than the Young's modulus of damper 10*b* and greater than the Young's modulus of edge 11*b*, independence of damper 10*a* and edge 11*a* is ensured for damper 10*b* and edge 11*b*. Namely, connection 23*b* is desirably harder than damper 10*b* and than edge 11*b*.

In order to establish the Young's modulus of connection 23*a* greater than the Young's modulus of damper 10*a* and than the Young's modulus of edge 11*a*, it is preferable to use a hard adhesive, say, based on acryl as an adhesive type for bonding between edge 11*a* and damper 10*a*. If reinforcing material (not shown) is pasted on connection 23*a*, the Young's modulus of connection 23*a* can be easily increased. Likewise, in order to establish the Young's modulus of connection 23*b* greater than the Young's modulus of damper 10*b* and than the Young's modulus of edge 11*b*, it is preferable to use a hard adhesive, say, based on acryl as an adhesive type for bonding between edge 11*b* and damper 10*b*. If reinforcing material (not shown) is pasted on connection 23*b*, the Young's modulus of connection 23*a* can be easily increased.

Figure 3:
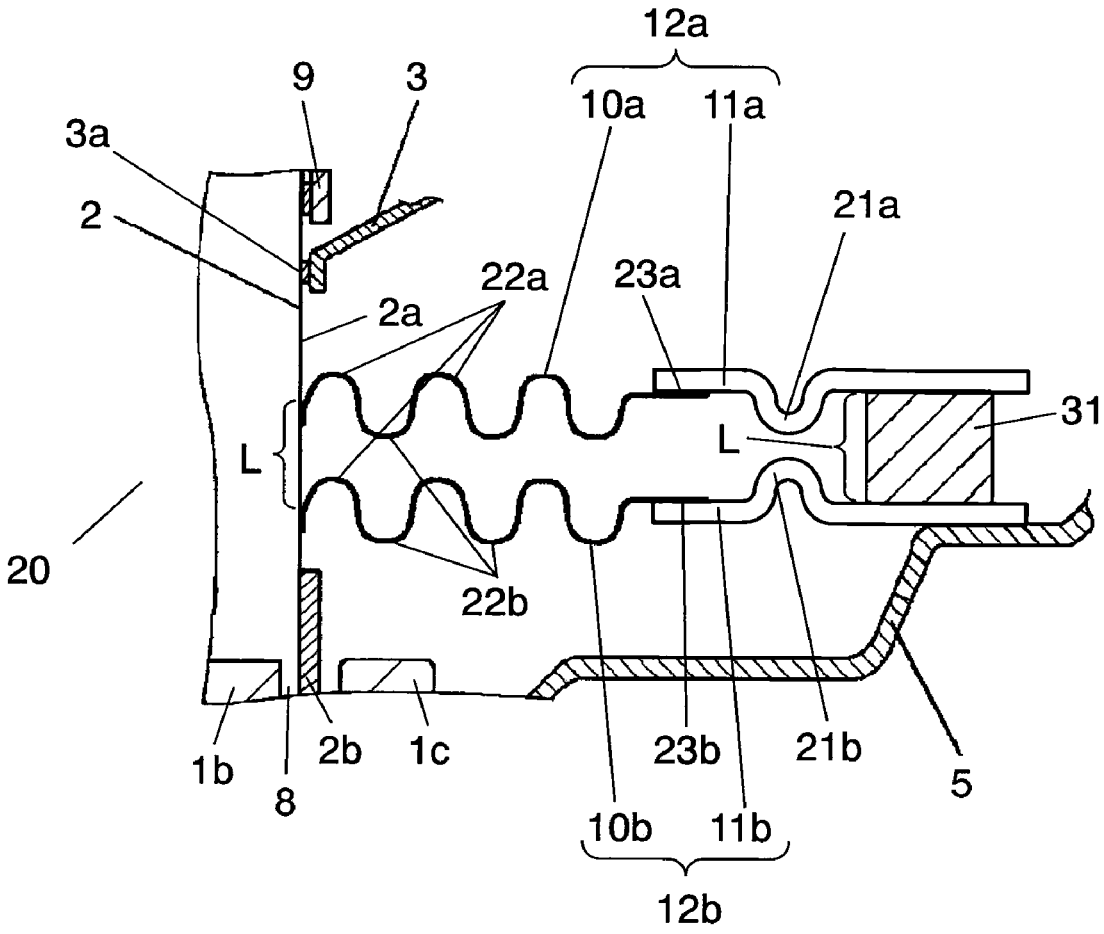
FIG. 3 is an essential-part magnifying sectional view of a loudspeaker according to another example of embodiment 1 of the invention.

FIG. 3 is an essential-part magnifying sectional view showing another example of loudspeaker 20 according to embodiment 1 of the invention. Loudspeaker 20 shown in FIG. 3 is different in edge 11*a*, 11*b* structure, i.e. combination 12*a*, 12*b* structure, from loudspeaker 20 shown in FIGS. 1 and 2, wherein the other elements are same in structure.

Namely, loudspeaker 20 shown in FIG. 3 has a structure that protrusion 21*a* of edge 11*a* protrudes in a direction opposite to diaphragm 3 while protrusion 21*b* of edge 11*b* protrudes in a direction toward diaphragm 3. Damper 10*a* and edge 11*a* constitute first combination 12*a* while damper 10*b* and edge 11*b* constitute second combination 12*b*. Edge 11*a* and edge 11*b* are fixed on frame 5, in a state integrated via spacer 31.

With loudspeaker shown in FIG. 3, loudspeaker 20 is provided that the sound generated by loudspeaker 20 is suppressed against distortions wherein driving efficiency of loudspeaker 20 is enhanced. Besides, loudspeaker 20 having high driving efficiency is obtainable for loudspeaker 20 for reproducing middle and higher ranges of sound because of loudspeaker 20 excursion part is easily weight-reduced.

Embodiment 2

Embodiment 2 of the invention is explained below by using figures. Note that similar reference character is attached to the similar structure to embodiment 1, to omit the detailed explanation thereof.

Figure 4:
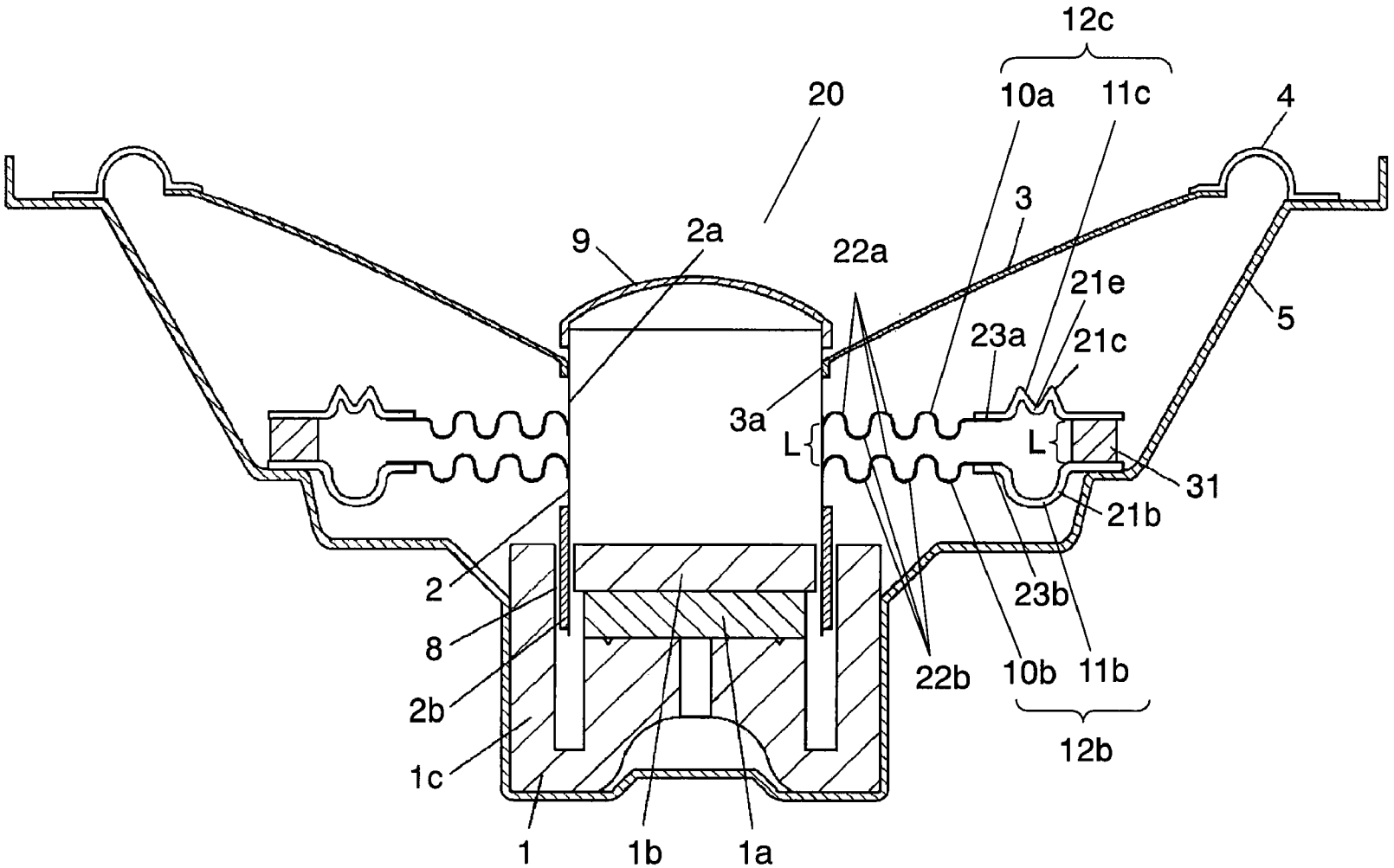
FIG. 4 is a sectional view of a loudspeaker according to embodiment 2 of the invention.
Figure 5:
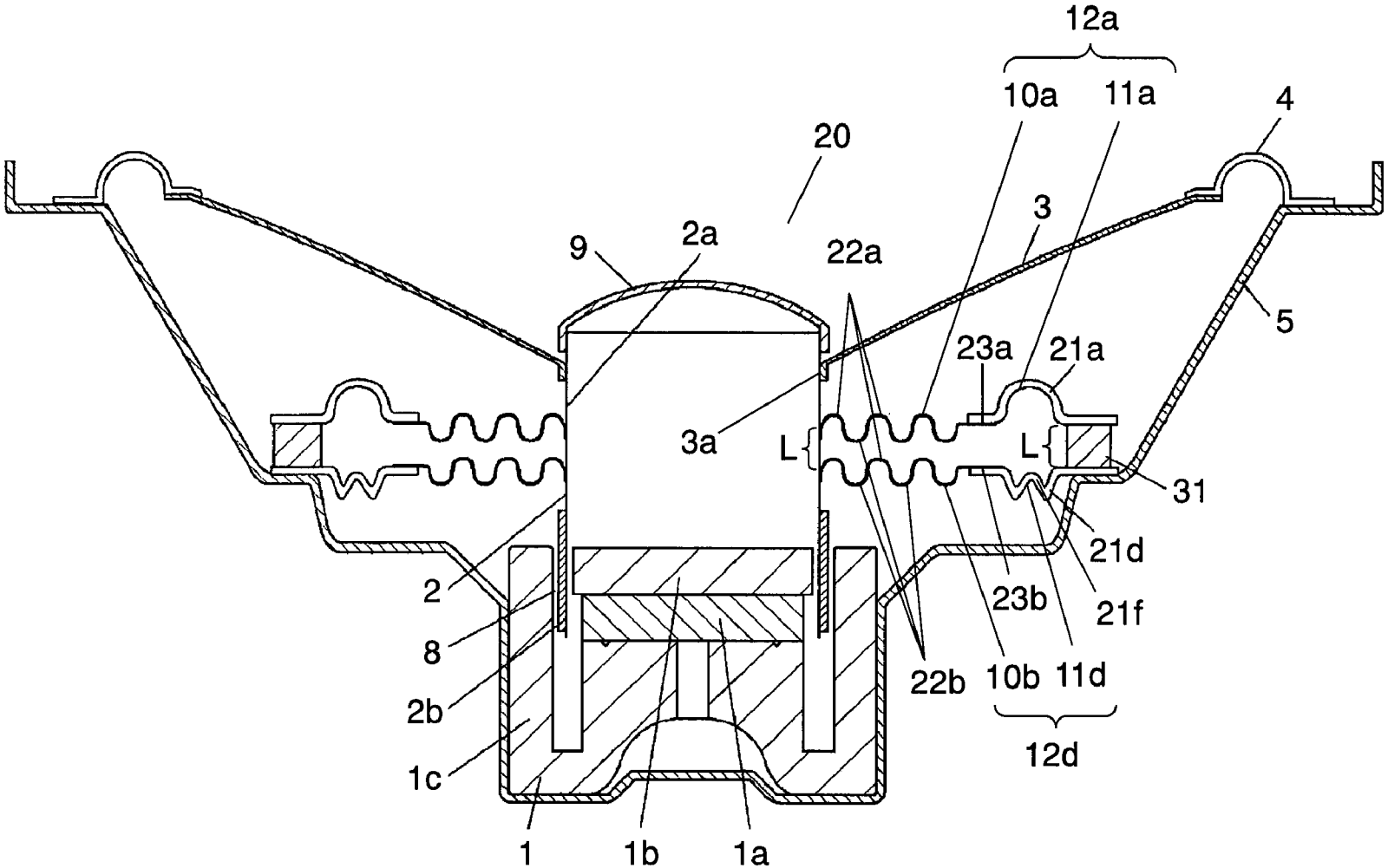
FIG. 5 is a sectional view of a loudspeaker according to another example of embodiment 2 of the invention.
Figure 6:
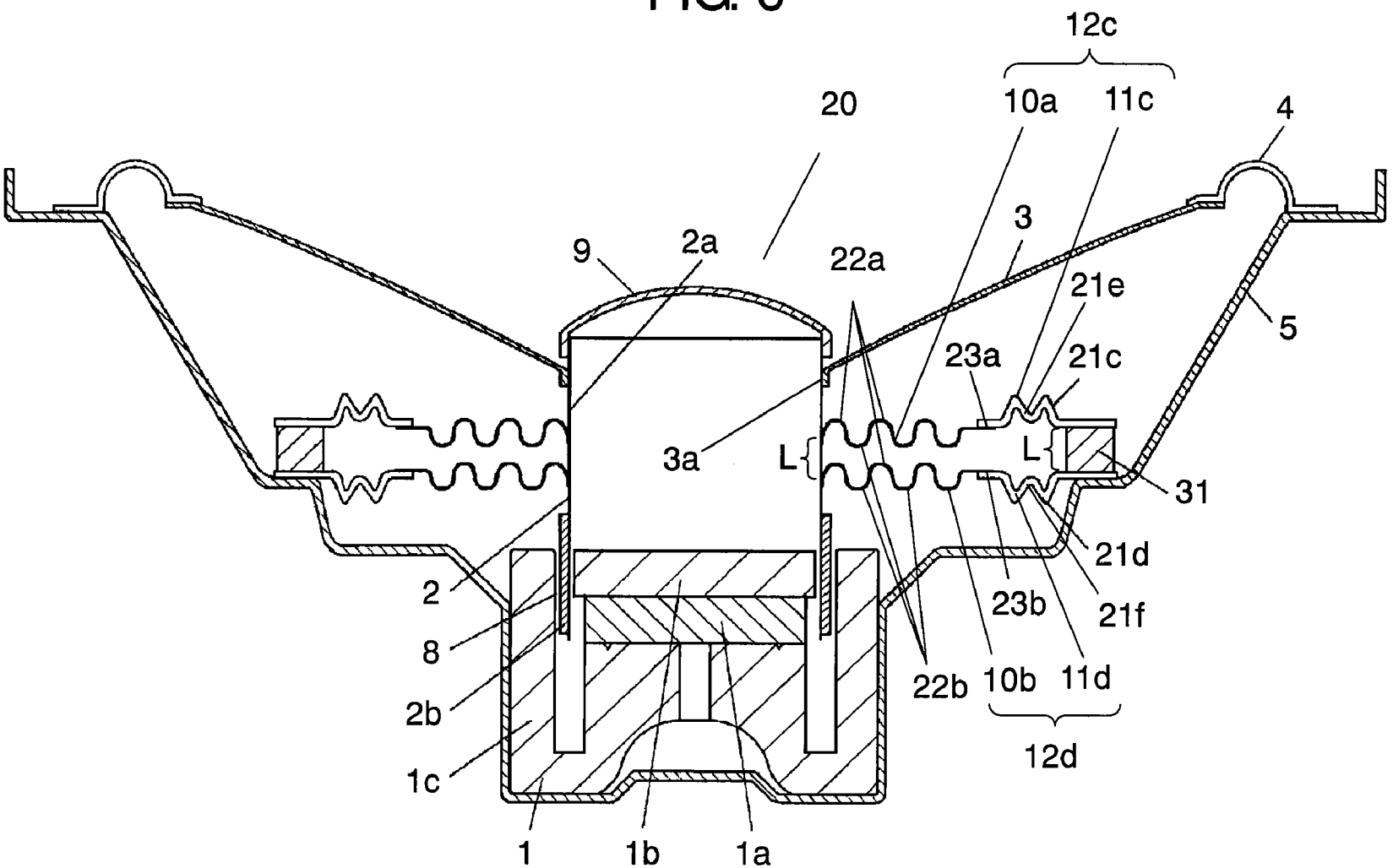
FIG. 6 is a sectional view of a loudspeaker according to still another example of embodiment 2 of the invention.

FIG. 4 is a sectional view showing loudspeaker 20 according to embodiment 2 of the invention. FIG. 5 is a sectional view showing another example of loudspeaker 20 according to embodiment 2 of the invention. FIG. 6 is a sectional view showing another example of loudspeaker 20 according to embodiment 2 of the invention. Loudspeaker 20 of embodiment 2 is different from loudspeaker 20 of embodiment 1 in respect of edge 11*a*, 11*b* structure, i.e. combination 12*a*, 12*b* structure, wherein the other elements are same in structure as embodiment 1.

First of all, loudspeaker 20 shown in FIG. 4 is provided with first edge 11*c* (hereinafter, referred to as edge 11*c*) in place of edge 11*a* of loudspeaker 20 of embodiment 1. Edge 11*c* has two first edge protrusions 21*c* (hereinafter, referred to as protrusions 21*c*) and one third edge protrusion 21*e* (hereinafter, referred to as protrusion 21*e*), thereby having a corrugated sectional form. Protrusion 21*c* protrudes in a direction toward diaphragm 3 while protrusion 21*e* protrudes in a direction opposite to diaphragm 3. Edge 11*c* is formed by use of a material of urethane foam resin, foam rubber, SBR rubber or cloth, in order not to apply a large movable load to diaphragm 3. Damper 10*a* and edge 11*c* constitute first combination 12*c*. Edge 11*c* and edge 11*b* are fixed on frame 5, in a state integrated together via spacer 31.

As shown in FIG. 4, edge 11*c* has two protrusions 21*c* protruding toward above in FIG. 4, i.e. in a direction toward diaphragm 3, and one protrusion 21*e* protruding in a direction opposite to diaphragm 3. Due to this, deformation readily occurs in the direction toward above in FIG. 4, i.e. toward diaphragm 3. Conversely, deformation does not readily occur in the direction toward below in FIG. 4, i.e. opposite to diaphragm 3. Consequently, by combining edge 11*b* and edge 11*c* in a manner as shown in FIG. 4, the magnitude of a vertical load on edge 11*b* and the magnitude of a vertical load on edge 11*c* are given substantially equal in state.

Furthermore, Young's modulus E1 of edge 11*c* is somewhat smaller as compared to Young's modulus E2 of edge 11*b*. Namely, edge 11*c* is somewhat less hard as compared to edge 11*b*. The reason Young's modulus E1 of edge 11*c* is somewhat smaller as compared to Young's modulus E2 of edge 11*b* is similar to the reason Young's modulus E1 of edge 11*a* is somewhat smaller as compared to Young's modulus E2 of edge 11*b* as was explained in embodiment 1. Accordingly, explanation in detail is omitted.

In loudspeaker 20 shown in FIG. 4, the vertical excursion of diaphragm 3 is given substantially symmetric with respect to the vertical, which reduces distortion of loudspeaker 20. Furthermore, because edge 4 greatest in plane shape is thin-walled and weight-reduced, the excursion part of loudspeaker 20 is easily weight-reduced. Thus, loudspeaker 20 having high driving efficiency is obtainable for loudspeaker 20 for reproducing middle and higher ranges of sound.

Loudspeaker 20 shown in FIG. 5 is provided with second edge 11*d* (hereinafter, referred to as edge 11*d*) in place of edge 11*b* of loudspeaker 20 of embodiment 1. Edge 11*d* has two second edge protrusions 21*d* (hereinafter, referred to as protrusions 21*d*) and one fourth edge protrusion 21*f* (hereinafter referred to as protrusion 21*f*), thereby having a corrugated sectional form. Protrusion 21*f* protrudes in a direction toward diaphragm 3 while protrusion 21*d* protrudes in a direction opposite to diaphragm 3. Edge 11*d* is formed by use of a material of urethane foam resin, foam rubber, SBR rubber or cloth, in order not to apply a large movable load to diaphragm 3. Damper 10*b* and edge 11*d* constitute second combination 12*d*. Edge 11*a* and edge 11*d* are fixed on the frame 5, in a state integrated together via spacer 31.

As shown in FIG. 5, edge 11*d* has one protrusion 21*f* protruding toward above in FIG. 5, i.e. in a direction toward diaphragm 3, and two protrusions 21*d* protruding below in FIG. 5, i.e. in a direction opposite to diaphragm 3. Due to this, deformation readily occurs in the direction toward below in FIG. 5, i.e. opposite to diaphragm 3. Conversely, deformation does not readily occur in the direction toward above in FIG. 5, i.e. toward diaphragm 3. Consequently, by combining edge 11*a* and edge 11*d* in a manner as shown in FIG. 5, the magnitude of a vertical load on edge 11*a* and the magnitude of a vertical load on edge 11*d* are given substantially equal in state.

Furthermore, Young's modulus E1 of edge 11*a* is somewhat smaller as compared to Young's modulus E2 of edge 11*d*. Namely, edge 11*a* is somewhat less hard as compared to edge 11*d*. The reason Young's modulus E1 of edge 11*a* is somewhat smaller as compared to Young's modulus E2 of edge 11*d* is similar to the reason Young's modulus E1 of edge 11*a* is somewhat smaller as compared to Young's modulus E2 of edge 11*b* as was explained in embodiment 1. Accordingly, explanation in detail is omitted.

In loudspeaker 20 shown in FIG. 5, the vertical excursion of diaphragm 3 is given substantially symmetric with respect to the vertical, which reduces distortions in loudspeaker 20. Furthermore, because edge 4 greatest in plane shape is thin-walled and weight-reduced, the excursion part of loudspeaker 20 is easily weight-reduced. Thus, loudspeaker 20 having high driving efficiency is obtainable for loudspeaker 20 for reproducing middle and higher ranges of sound.

Loudspeaker 20 shown in FIG. 6 is provided with edges 11*c*, 11*d* in place of edges 11*a*, 11*b* of loudspeaker 20 of embodiment 1. Damper 10*a* and edge 11*c* constitute first combination 12*c*. Likewise, damper 10*b* and edge 11*d* constitute second combination 12*d*. Edge 11*c* and edge 11*d* are fixed on frame 5, in a state integrated together via spacer 31.

As shown in FIG. 6, edge 11*d* has one protrusion 21*f* protruding in a direction toward diaphragm 3 and two protrusions 21*d* protruding in a direction opposite to diaphragm 3. Due to this, deformation readily occurs in the direction opposite to diaphragm 3, and conversely deformation does not readily occur in the direction toward diaphragm 3. Meanwhile, edge 11*c* has two protrusions 21*c* protruding in a direction toward diaphragm 3 and one protrusion 21*e* protruding in a direction opposite to diaphragm 3. Due to this, deformation readily occurs in the direction toward diaphragm 3, and conversely deformation does not readily occur in the direction opposite to diaphragm 3. Due to this, by combining edge 11*c* and edge 11*d* as shown in FIG. 6, the magnitude of vertical load on edge 11*c* and the magnitude of vertical load on edge 11*d* are given substantially equal in state.

Young's modulus E1 of edge 11*c* is somewhat smaller as compared to Young's modulus E2 of edge 11*d*. Namely, edge 11*c* is somewhat less hard as compared to edge 11*d*. The reason Young's modulus E1 of edge 11*c* is somewhat smaller as compared to Young's modulus E2 of edge 11*d* is similar to the reason Young's modulus E1 of edge 11*a* is somewhat smaller as compared to Young's modulus E2 of edge 11*b* as was explained in embodiment 1. Accordingly, explanation in detail is omitted.

In loudspeaker 20 shown in FIG. 6, the vertical excursion of diaphragm 3 is given substantially symmetric with respect to the vertical, which reduces distortion of loudspeaker 20. Furthermore, because edge 4 greatest in plane shape is thin-walled and weight-reduced, the excursion part of loudspeaker 20 is easily weight-reduced. Thus, loudspeaker 20 having high driving efficiency is obtainable for loudspeaker 20 for reproducing middle and higher ranges of sound.

Embodiment 3

Embodiment 3 of the invention is explained below by use of figures. Note that similar reference character is attached to the similar structure to embodiment 1 or 2, to omit the detailed explanation thereof.

Figure 7:
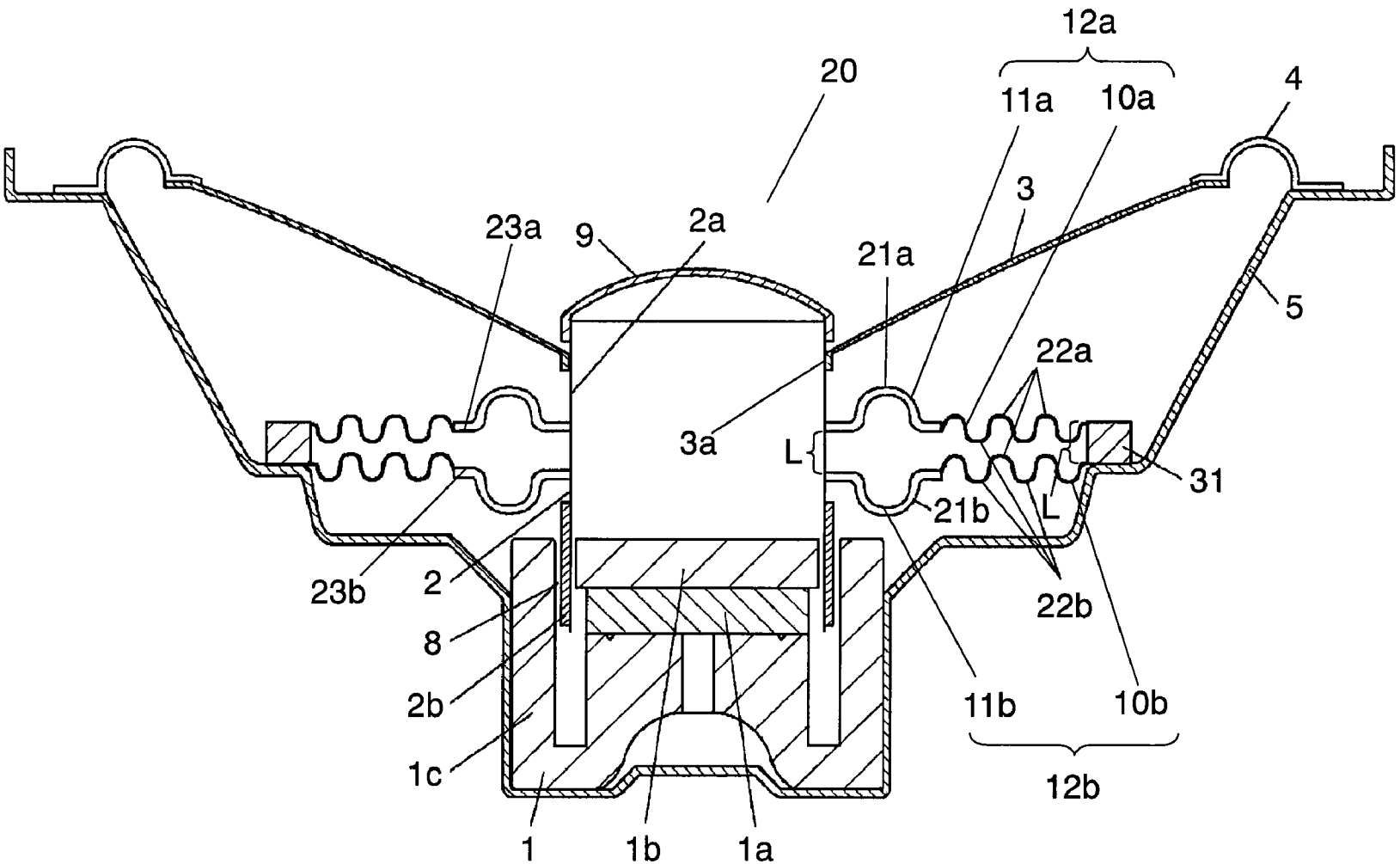
FIG. 7 is a sectional view of a loudspeaker according to embodiment 3 of the invention.
Figure 8:
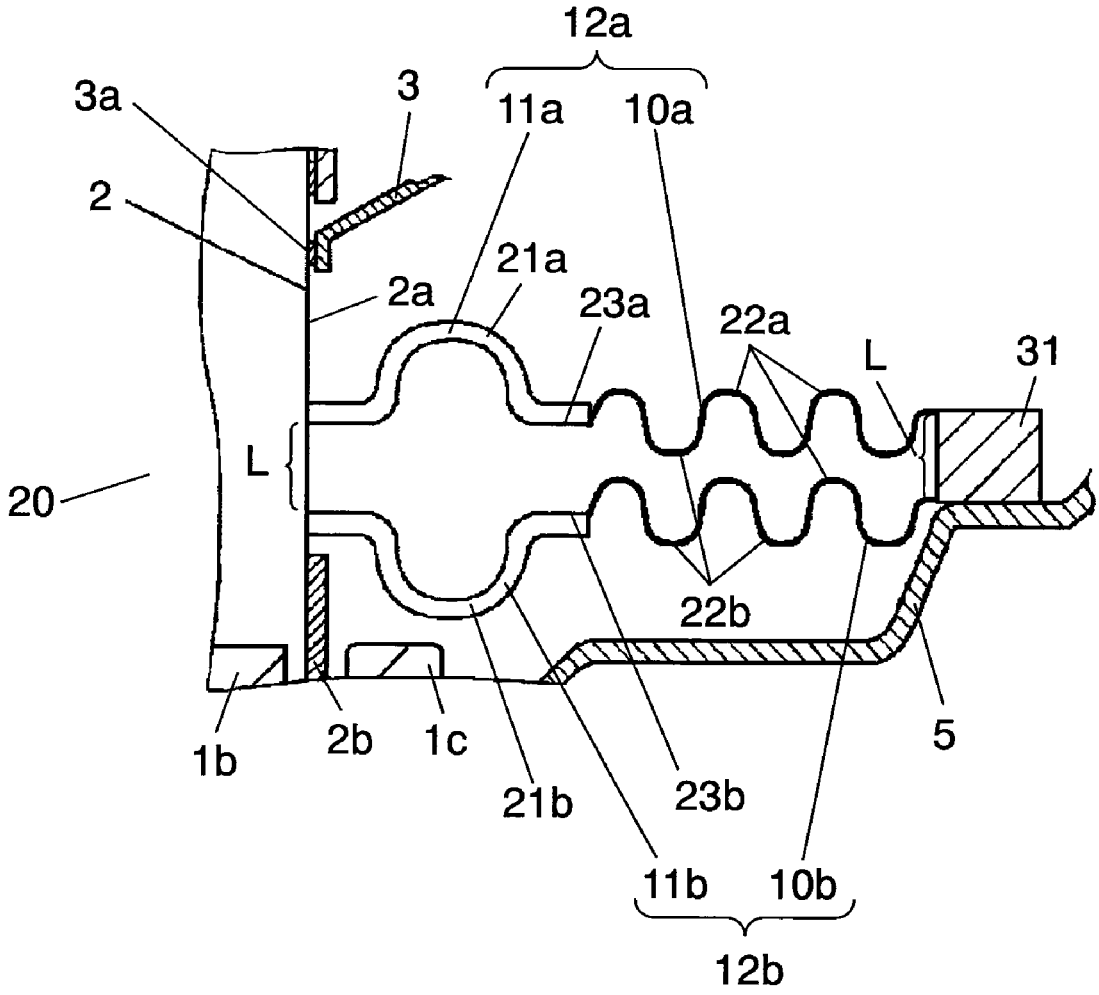
FIG. 8 is an essential-part magnifying sectional view of the loudspeaker shown in FIG. 7.

FIG. 7 is a sectional view showing loudspeaker 20 according to embodiment 3 of the invention. FIG. 8 is an essential-part magnifying view of loudspeaker 20 shown in FIG. 7. Loudspeaker 20 of embodiment 3 is different from loudspeaker 20 of embodiment 1 or 2 in respect of first combination 12*a* structure and second combination 12*b* structure, wherein the other elements are same in structure as embodiment 1 or 2.

Namely, damper 10*a* and damper 10*b* at their outer rims are fixed on frame 5, in a state integrated together via spacer 31, as shown in FIGS. 7 and 8. Spacer 31 has a height dimension L so that dampers 10*a*, 10*b* are fixed on frame 5 with predetermined distance L. Furthermore, damper 10*a* has an inner rim connected to an outer rim of main body 2*a* of voice coil 2 via edge 11*a* separate from damper 10*a*. Likewise, damper 10*b* has an inner rim connected to an outer rim of main body 2*a* of voice coil 2 via edge 11*b* separate from damper 10*b*. Edges 11*a*, 11*b* are connected on main body 2*a* in a position closer to the magnetic circuit 1 than fixing region 3*a* of diaphragm 3. Edge 11*a* and Edge 11*b* are connected on main body 2*a*, with predetermined distance L of spacing. Damper 10*a* and edge 11*a* constitutes first combination 12*a*. Likewise, damper 10*b* and edge 11*b* constitutes second combination 12*b*. The spacing between dampers 10*a* and 10*b* and the spacing between edges 11*a* and 11*b* are both structured with predetermined distance L of spacing. However, the spacing between dampers 10*a* and 10*b* and the spacing between edges 11*a* and 11*b* are not necessarily limited to the spacing equality. Those may be determined by taking account of the forms of dampers 10*a*, 10*b*, edges 11*a*, 11*b*, spacer 31 and so on.

In loudspeaker 20 of embodiment 3, when an audio signal is inputted to coil 2*b*, voice coil 2 operates vertically in response to a magnetic field formed in the magnetic gap 8 similarly to loudspeaker 20 of embodiment 1 or 2. By the operation of the voice coil 2, diaphragm 3 is vibrated to generate sound from loudspeaker 20. Particularly, by the provision of edges 11*a*, 11*b* at inner rims of dampers 10*a*, 10*b*, the sound generated by loudspeaker 20 is suppressed from distorting, further enhancing the driving efficiency of loudspeaker 20. Meanwhile, the excursion part of loudspeaker 20 is easily reduced in weight. Thus, loudspeaker 20 having high driving efficiency is obtainable for loudspeaker 20 for reproducing middle and higher ranges of sound.

Figure 9:
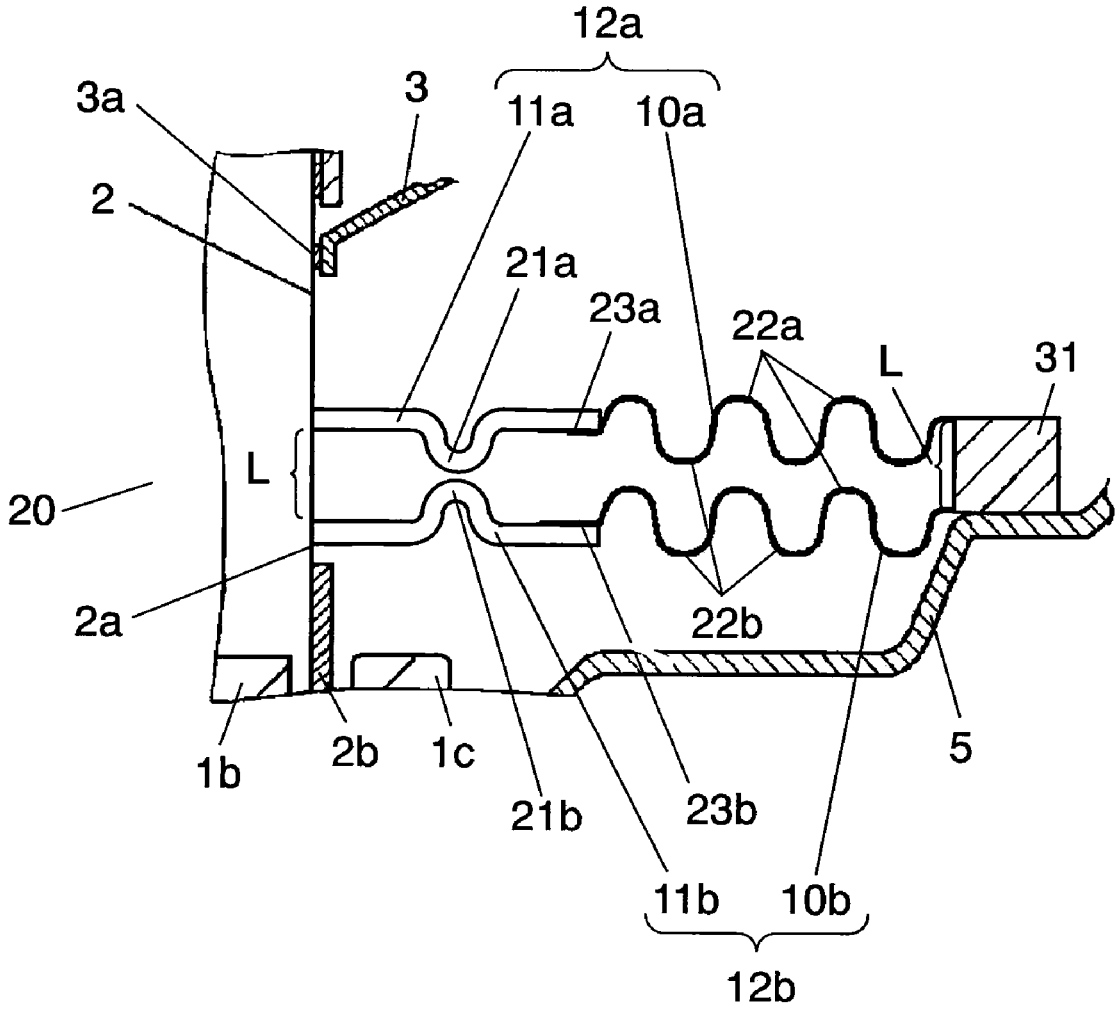
FIG. 9 is an essential-part magnifying sectional view of a loudspeaker according to another example of embodiment 31 of the invention.

FIG. 9 is an essential-part magnifying sectional view showing another embodiment of loudspeaker 20 according to embodiment 3 of the invention. Loudspeaker 20 shown in FIG. 9 is different in edge 11*a*, 11*b* structure, i.e. combination 12*a*, 12*b* structure, from loudspeaker 20 shown in FIGS. 7 and 8, wherein the other elements are same in structure.

Namely, in loudspeaker 20 shown in FIG. 9, edge 11*a* has protrusion 21*a* that protrudes in a direction opposite to diaphragm 3 while edge 11*b* has protrusion 21*b* that protrudes in a direction toward diaphragm 3. Damper 10*a* and edge 11*a* constitutes first combination 12*a* while damper 10*b* and edge 11*b* constitutes second combination 12*b*. Damper 10*a* and damper 10*b* are fixed on the frame 5, in a state integrated together via spacer 31.

With loudspeaker shown in FIG. 9, loudspeaker 20 is provided that the sound generated by loudspeaker 20 is suppressed against distortions further with driving efficiency of loudspeaker 20 enhanced. Likewise, loudspeaker 20 with high driving efficiency is obtainable for loudspeaker 20 for reproducing middle and higher ranges of sound because of loudspeaker 20 excursion part is easily weight-reduced.

Embodiment 4

Embodiment 4 of the invention is explained below by use of figures. Note that similar reference character is attached to the similar structure to embodiment 1, 2 or 3, to omit the detailed explanation thereof.

Figure 10:
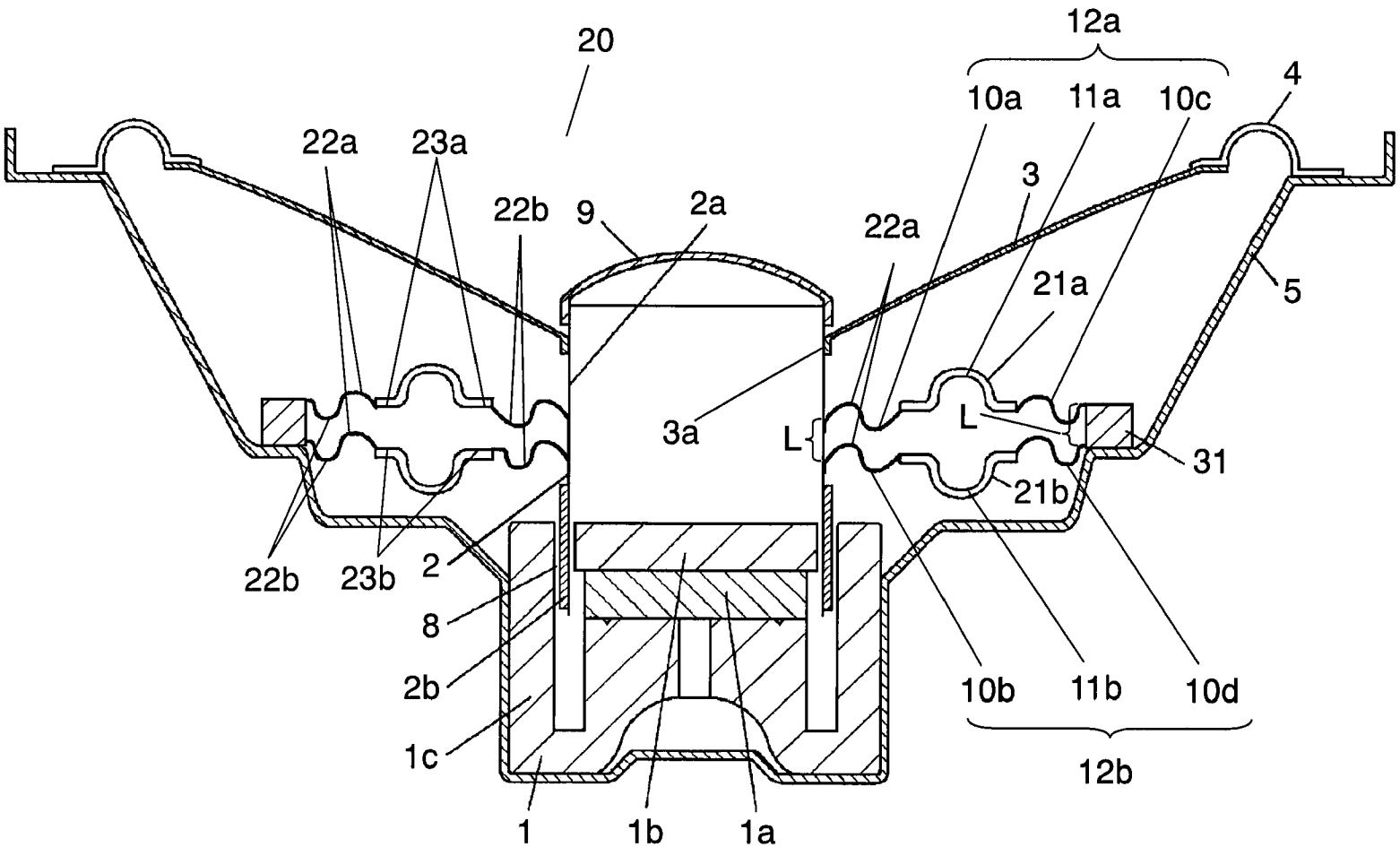
FIG. 10 is a sectional view of a loudspeaker according to embodiment 4 of the invention.
Figure 11:
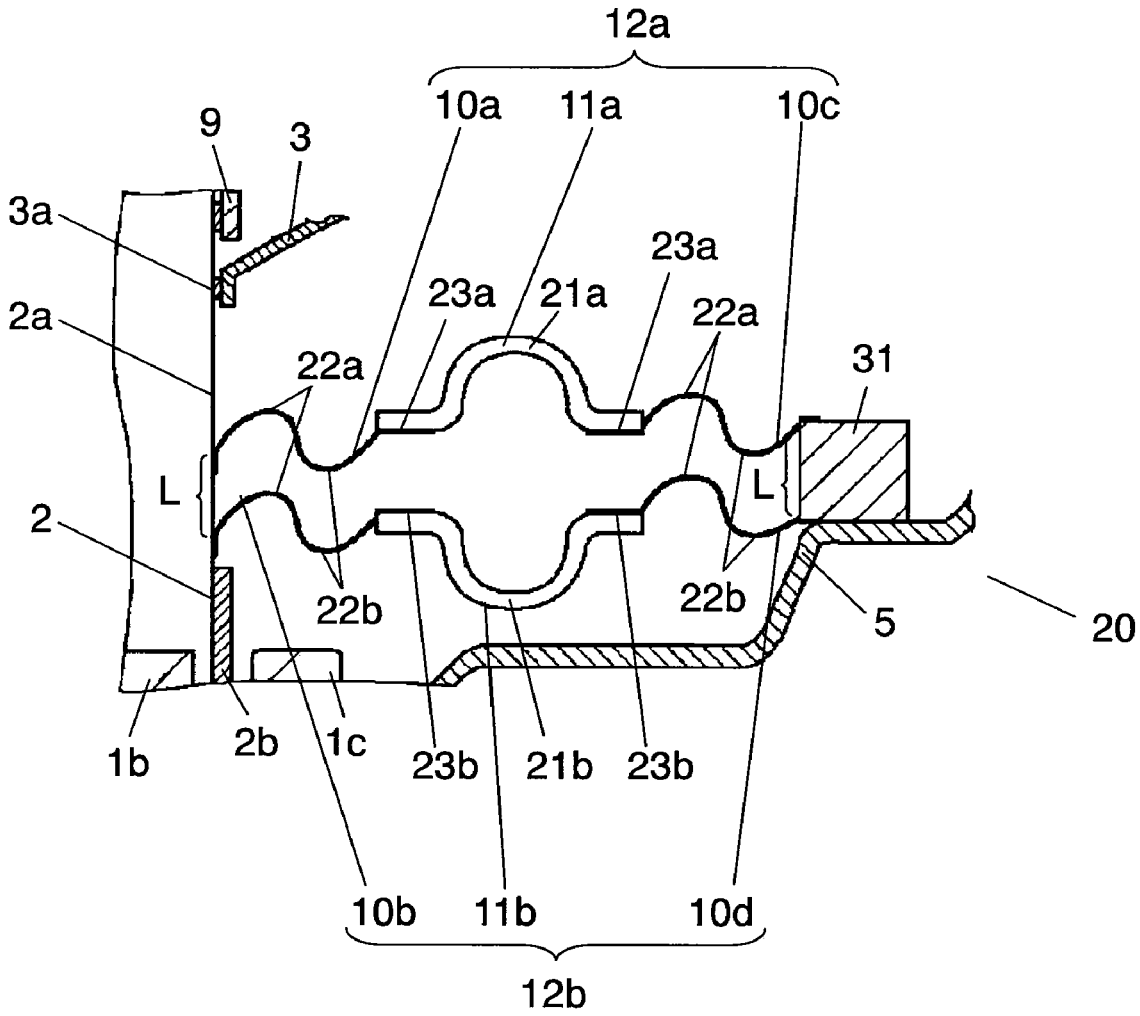
FIG. 11 is an essential-part magnifying sectional view of the loudspeaker shown in FIG. 10.
Figure 12:
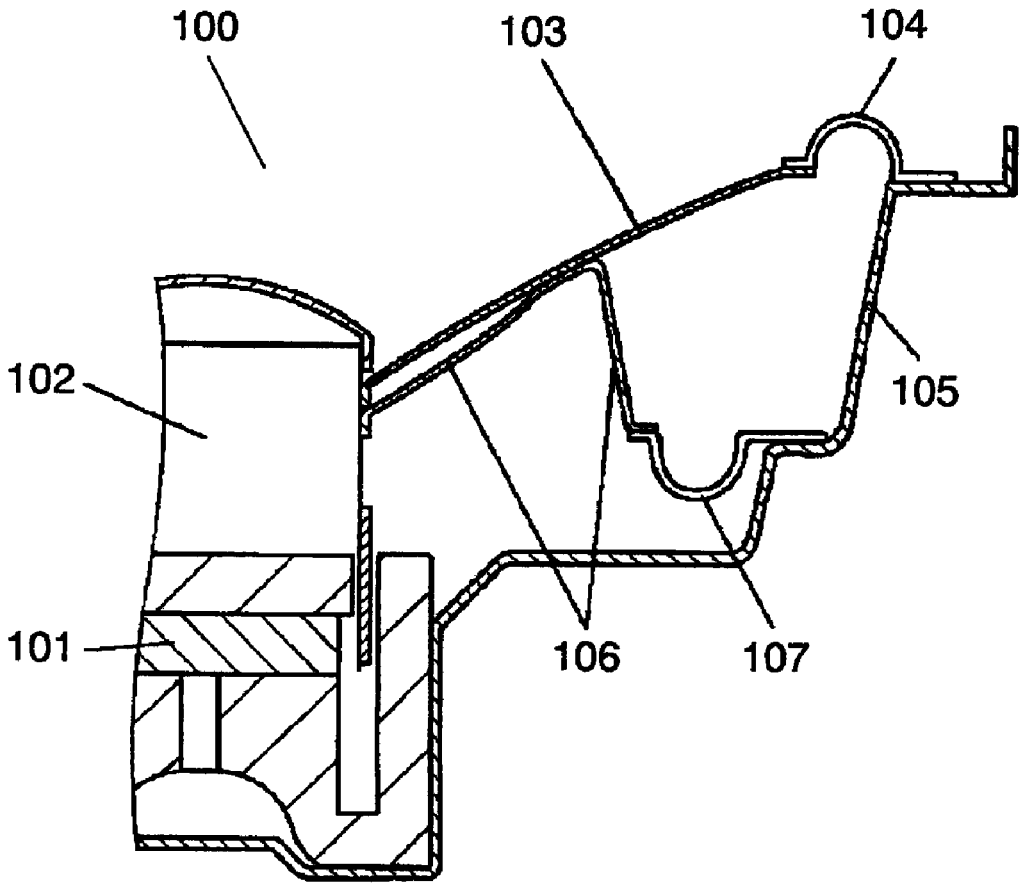
FIG. 12 PRIOR ART
FIG. 12 is a sectional view of a conventional loudspeaker.

FIG. 10 is a sectional view showing loudspeaker 20 according to embodiment 4 of the invention. FIG. 11 is an essential-part magnifying view of loudspeaker 20 shown in FIG. 10. Loudspeaker 20 of embodiment 4 is different from loudspeaker 20 of embodiment 1, 2 or 3 in respect of first combination 12*a* structure and second combination 12*b* structure, wherein the other elements are same in structure as embodiment 1.

In loudspeaker 20 shown in FIGS. 10 and 11, third damper 10*c* (hereinafter, referred to as damper 10*c*) is inserted between the outer rim of edge 11*a* and frame 5 of loudspeaker 20 according to embodiment 1. Likewise, fourth damper 10*d* (hereinafter, referred to as damper 10*c*) is inserted between the outer rim of edge 11*b* and frame 5. Damper 10*a*, edge 11*a* and damper 10*c* constitute first combination 12*a*. Likewise, damper 10*b*, edge 11*b* and damper 10*d* constitute second combination 12*b*. Damper 10*a* and damper 10*b* are fixed on frame 5, in a state integrated together via spacer 31.

As shown in FIGS. 10 and 11, dampers 10*c*, 10*d* are of a corrugated ring-like structure similarly to dampers 10*a*, 10*b*. This provides a structure allowing for being flexible correspondingly to a vertical excursion of voice coil 2. Dampers 10*c*, 10*d* are formed using a material of urethane foam resin, foam rubber, SBR rubber or cloth, in order not to apply a large movable load to diaphragm 3, similarly to dampers 10*a*, 10*b*. Dampers 10*c*, 10*d* are each structured having, in plurality, third protrusion protruding 22*a* in a direction toward diaphragm 3 and fourth protrusion 22*b* protruding in a direction opposite to third protrusion 22*a*. Accordingly, basically, vertical load is substantially equal at dampers 10*c*, 10*d*. Due to this, loudspeaker 20 is identical in basic operation, function and effect to the foregoing embodiments 1, 2 and 3.

Accordingly, in loudspeaker 20 shown by embodiment 4, the vertical excursion of diaphragm 3 is substantially symmetric with respect to the vertical, thus reducing distortion at loudspeaker 20. Furthermore, edge 4 greatest in plane shape is thin-walled and weight-reduced thus reducing the weight of the excursion part of loudspeaker 20. Thus, loudspeaker 20 having high driving efficiency is obtainable for loudspeaker 20 for reproducing middle and higher ranges of sound.

INDUSTRIAL APPLICABILITY

Distortion of the loudspeaker in the invention is reduced in the sound generated by the loudspeaker and improved in driving efficiency. This results in usefulness particularly for loudspeakers for middle and higher range applications.

The invention claimed is:

1. A loudspeaker comprising:

a frame a magnetic circuit supported by the frame and for forming a magnetic gap;

a voice coil arranged movable relative to the magnetic gap;

a diaphragm having an outer rim connected to the frame via a diaphragm edge and an inner rim connected to the voice coil;

a first combination provided closer to the magnetic circuit than the diaphragm and having a first damper and a first edge, thus having an inner rim connected to the voice coil and an outer rim connected to the frame; and a second combination provided closer to the magnetic circuit than the diaphragm and having a second damper and a second edge, thus having an inner rim connected to the voice coil and an outer rim connected to the frame, the first edge having a first edge protrusion protruding in a direction toward the diaphragm or in a direction opposite to the diaphragm, and the second edge having a second edge protrusion protruding in a direction opposite to the protruding direction of the first edge protrusion, wherein the first combination has a Young's modulus and the second combination has a Young's modulus that is greater than a Young's modulus of the diaphragm edge, the first edge has a Young's modulus smaller than a Young's modulus of the second edge, the first edge has a Young's modulus greater than a Young's modulus of the diaphragm edge, and a connection between the first damper and the first edge has a Young's modulus greater than a Young's modulus of the first damper and a Young's modulus of the first edge, and a connection between the second damper and the second edge has a Young's modulus greater than a Young's modulus of the second damper and a Young's modulus of the second edge.

2. The loudspeaker of claim 1, wherein the first damper and the second damper are both connected to the voice coil, the first edge and the second edge being both connected to the frame.

3. The loudspeaker of claim 2, wherein the first combination has a third damper provided between the first edge and the frame, the second combination having a fourth damper provided between the second edge and the frame.

4. The loudspeaker of claim 1, wherein the first damper and the second damper are both connected to the frame, the first edge and the second edge being both connected to the voice coil.

5. The loudspeaker of claim 1, wherein the first edge is formed by use of foam rubber while the second edge is formed by use of rubber material.

6. The loudspeaker of claim 5, wherein the diaphragm edge and the first edge are formed by use of foam urethane resin.

* * * * *